United States Patent [19]

Jetter

[11] 4,316,273

[45] Feb. 16, 1982

[54] REMOTE-CONTROLLED ALARM CLOCK

[76] Inventor: Milton W. Jetter, 800 4th St., SW., Washington, D.C. 20024

[21] Appl. No.: 131,122

[22] Filed: Mar. 17, 1980

[51] Int. Cl.[3] ..... G04C 11/02; G04C 21/16; G04B 23/00

[52] U.S. Cl. ..... 368/47; 368/249; 368/250; 368/262; 340/825.44; 340/825.69

[58] Field of Search ..... 368/72, 73, 46, 47, 368/55, 109, 245, 249, 250, 251, 255, 262; 340/384 E, 384 R, 147 R, 164 R, 164 A, 164 B

[56] References Cited

U.S. PATENT DOCUMENTS

| | | | |
|---|---|---|---|
| 2,721,611 | 10/1955 | Gordon | 368/250 |
| 2,856,751 | 10/1958 | Preiser | 368/250 |
| 3,748,846 | 7/1973 | Kikuchi | 368/47 |
| 4,216,647 | 8/1980 | Hattori | 368/73 |
| 4,218,875 | 8/1980 | Rothman | 368/73 |
| 4,234,944 | 11/1980 | Komari et al. | 368/72 |
| 4,246,651 | 1/1981 | Komatsu et al. | 368/73 |

*Primary Examiner*—Vit W. Miska
*Attorney, Agent, or Firm*—Herman L. Gordon

[57] ABSTRACT

An alarm clock system consisting of a clock with a local alarm circuit and provided with a remotely located turn-off control device actuated by a push button switch. The local alarm system, in response to an electrical signal produced by the clock at a preset time, generates a first sound in the form of a continuous tone lasting for 40 seconds, followed by a strident pulsating sound for another 40 seconds. To turn off the alarm, the user must get out of bed, walk to the remote location, and then depress the switch push button and hold it for a predetermined time, such as 12 seconds. Actuation of the push button switch causes the remote control component to generate and transmit a radio signal, which is detected by a radio receiver in the alarm clock local component. Also, an indicating lamp on the remote component is energized and goes off after 12 seconds of continuous depression of the push button. The radio signal received by the local component causes interruption of the alarm and completely deactivates the alarm mode after 12 seconds of push button depression. If the pushbutton is released, namely, before 12 seconds, transmission of the radio signal stops and the clock alarm resumes. The push button must again be depressed to start another alarm-deactivation period. The system is arranged so that if so desired, a direct connection of the pushbutton switch alarm turn-off component can be made to the clock component, and the radio link is not used. As another alternative, the remote transmitter can be coupled to the clock radio receiver by a coaxial cable.

20 Claims, 5 Drawing Figures

POWER SUPPLY

REMOTE-CONTROLLED ALARM CLOCK

FIELD OF THE INVENTION

This invention relates to alarm clocks, and more particularly to an alarm clock system having a remotely-located deactivating means.

BACKGROUND OF THE INVENTION

Alarm clocks have heretofore been provided with various types of deactivation mechanisms and devices for enabling a user to shut off the alarm after it has become activated. In the case of mechanical alarm clocks, manually operated stop devices have been employed. With electrically operated clocks, switch devices or various types of combined mechanical and electrical alarm-deactivation means have been employed. In practically all of the previously employed alarm-deactivation devices, the user is not required to get out of bed, and the alarm clock is usually placed conveniently within reach so that when its alarm becomes activated it can be readily reached for deactivation by the user. This turns out to be a serious disadvantage, since the alarm can be deactivated before the awakened person is fully awake, and thus there is a great temptation to go back to sleep, since it takes some time for an awakened person's brain to reach a fully functioning state.

Various types of quasi-remote-controlled alarm deactivation devices have been proposed, such as by verbal command, by the use of bed switches controlled by the sleeper's weight, by photo-electric systems, by touch control, and the like. Most of these deactivation devices are unsatisfactory, as being excessively complicated, unreliable in operation, too expensive, and not effective to adequately awaken the user. Thus, these previously proposed devices do not require the individual to get out of bed, walk to a designated location, and delay return for a time sufficient to enable the individual to become fully awake by the time the process of deactivating the alarm is completed. The time factor and the walking factor are quite important, since walking increases the blood circulation and assists the person's brain to reach a fully functional condition by the time the alarm is deactivated, especially when reaching such a functional condition requires a degree of concentration.

Therefore, a large percentage of prior clock alarm systems fail in their underlying purpose in that individuals learn to defeat these systems without being fully awake, and become accustomed to routinely going back to sleep after turning off the alarm. For this reason there is a definite need for an alarm deactivation system requiring a behavior pattern which ensures that the individual becomes fully awake by the time the alarm is completely deactivated.

A preliminary search of the prior art revealed the following prior U.S. Pat. Nos. of interest:

Newman, 2,239,160
Belich, 2,496,373
Dias, 3,005,919
Atkins et al, 3,081,594
Kleinerman, 3,320,739
McLeod et al, 3,498,047
Welty, 3,855,574
Scheer et al, 4,084,104
Yamazaki et al, 4,121,414.

SUMMARY OF THE INVENTION

The alarm clock system of the present invention includes a clock with a local alarm system and with a remotely located turn-off control device having an alarm deactivation device, such as a manual push button switch. The local alarm system has means to generate two separate and distinct alarm sounds, consisting of a first sound in the form of a continuous tone sounding for an initial period, such as 40 seconds, followed by a more strident shrill, pulsating sound for a second period, such as another 40 seconds. To turn off the alarm, the user must get out of bed, walk to said remote location, and then depress the switch push button and hold it depressed for a preset time, such as 12 seconds. The depression of the push button causes the remote control component to generate and transmit a radio-frequency coded control signal which is detected by a radio receiver in the alarm clock component. Also, an indicating lamp on the remote component is energized. The alarm clock radio receiver causes interruption of the alarm responsive to the radio signal. The alarm clock completely deactivates the alarm mode responsive to the depression of the push button for 12 seconds. If the push button is prematurely released, namely, before the expiration of 12 seconds, transmission of the radio signal stops and the clock alarm resumes. The push button must again be held in a depressed condition to start another 12-second alarm-deactivation time period. When the push button is depressed, the indicating lamp will remain energized until the required 12-second deactivation period is completed.

Accordingly, a main object of the invention is to overcome the deficiencies and disadvantages of the previously employed clock alarm deactivation systems.

A further object of the invention is to provide an improved alarm clock with an electrical control system which can be used to require sufficient effort and concentration by the user when he attempts to deactivate the clock alarm to ensure that the user reaches a wakeful state as a result of the deactivation procedure, thereby accomplishing the intended purpose of the alarm.

A still further object of the invention is to provide an improved clock alarm system which has an alarm deactivating arrangement which enforces the user to employ a special degree of attention when he attempts to deactivate the alarm, and which requires mental concentration by the user over a sufficient time period to produce substantially complete wakefulness, the improved system being relatively simple in construction, involving inexpensive and readily available components, and having a wide range of versatility in usage in that it can be arranged either with a remote control station or as a substantially self-contained composite assembly.

A still further object of the invention is to provide an improved electrical clock alarm system wherein deactivation of its alarm requires that the user leave his bed and walk to a relatively remote location and perform a simple but positive act lasting over a period of time sufficient to bring the individual to a condition of wakefulness, the system employing relatively simple circuitry which is safe to use and which is economical in energy consumption.

A still further object of the invention is to provide an improved electronic alarm clock with a deactivation system including remotely controlled deactivation circuitry and including a remotely located deactivation station using a low-power radio frequency transmitter and a manual push button switch which must be continuously depressed by the user for a substantial time period in order to achieve complete alarm deactivation, and wherein the alarm clock, unless deactivated, provides a first continuous tone which is replaced after a time period by a relatively shrill strident sound.

A still further object of the invention is to provide an improved clock with an electronic alarm system which is arranged to generate an audible alarm consisting of a first relatively low level audible signal in the form of a continuous tone lasting for a predetermined period, after which it is replaced by a much more strident audible signal lasting for another predetermined period, and which has a remote control station for deactivating the alarm by means of a radio frequency control signal whose production requires that the user manually depress a push button switch at said remote location, with complete deactivation taking place after a sustained time period of depression of the switch push button, the remote station having indicating means to show when the required sustained time period of button depression has been completed.

A still further object of the invention is to provide an improved clock alarm control system which employs electronic alarm circuitry, which may be readily adapted for use with existing alarm clocks, and which may employ a coded radio frequency signal from a remote location for deactivating its alarm circuitry or alternatively, may be employed in a manner providing direct transmission of a deactivation signal to the alarm circuitry.

BRIEF DESCRIPTION OF THE DRAWINGS

Further objects and advantages of the invention will become apparent from the following description and claims, and from the accompanying drawings, wherein:

DETAILED DESCRIPTION OF A PREFERRED EMBODIMENT

Figure 1:
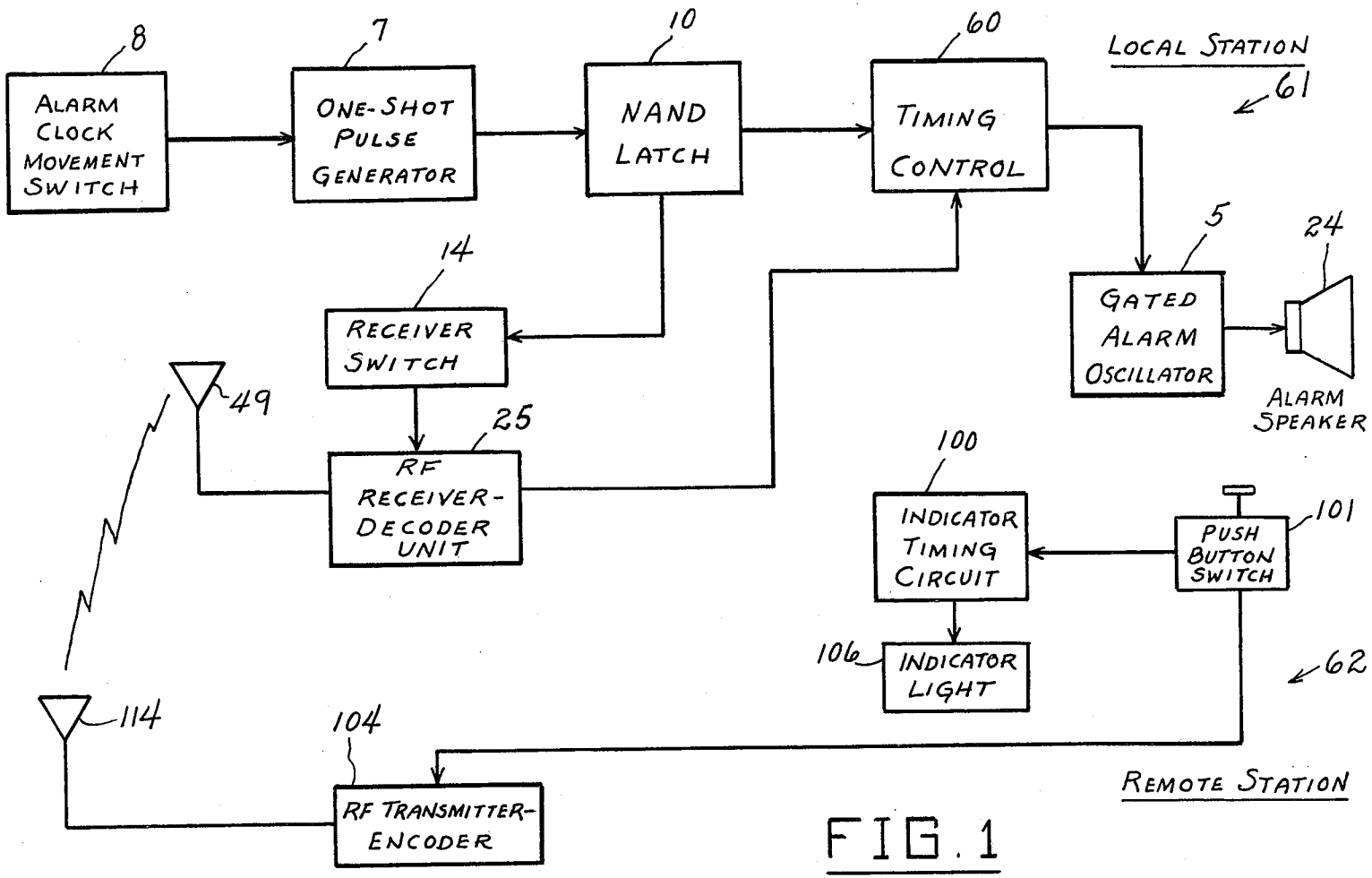
FIG. 1 is a block diagram of an improved clock alarm system constructed in accordance with the present invention.

Referring to the drawings, FIG. 1 illustrates a typical clock alarm control system according to the present invention, comprising a local clock component station, designated generally at 61, and a remote deactivation station, designated generally at 62. The remote station 62 may be located at a suitable distance from the local station 61, for example, in the bathroom or kitchen, or at any other desired remote location at a substantial walking distance from the user's bed. The clock component station comprises an alarm clock switch unit 8, which provides an alarm-starting signal at a preset time. The starting signal activates a one-shot pulse generator 7, which in turn sets a NAND latch unit 10. The latch unit 10 energizes a receiver switch unit 14 which turns on an RF receiver-decoder unit 25 and also causes energization of a timing control unit 60. Unit 60 activates a gated alarm oscillator unit 5 which drives an alarm speaker 24, adapted to provide an initial low level tone and a subsequent more strident noise, as will be presently described.

The remote station 62 comprises a coded RF transmitter-encoder unit 104 controlled by a manual push button switch unit 101 for energizing the transmitter. The push button switch unit 101 is provided with an indicator lamp 106 which is controlled by an indicator timing circuit 100 activated by the push button switch unit 101. The timing circuit 100 provides timed energization of the indicator lamp 106 when push button switch 101 is closed. The transmitter 104 is energized by the closure of switch 101 and transmits an RF coded signal to receiver 25, which decodes this RF signal and delivers an output signal to the timing control unit 60, which in turn interrupts the operation of oscillator unit 5 and silences the alarm speaker 24.

The RF signal from transmitter unit 104 is suitably coded to prevent interference with other RF signals from radio frequency equipment in the service area.

Figures 2, 3:
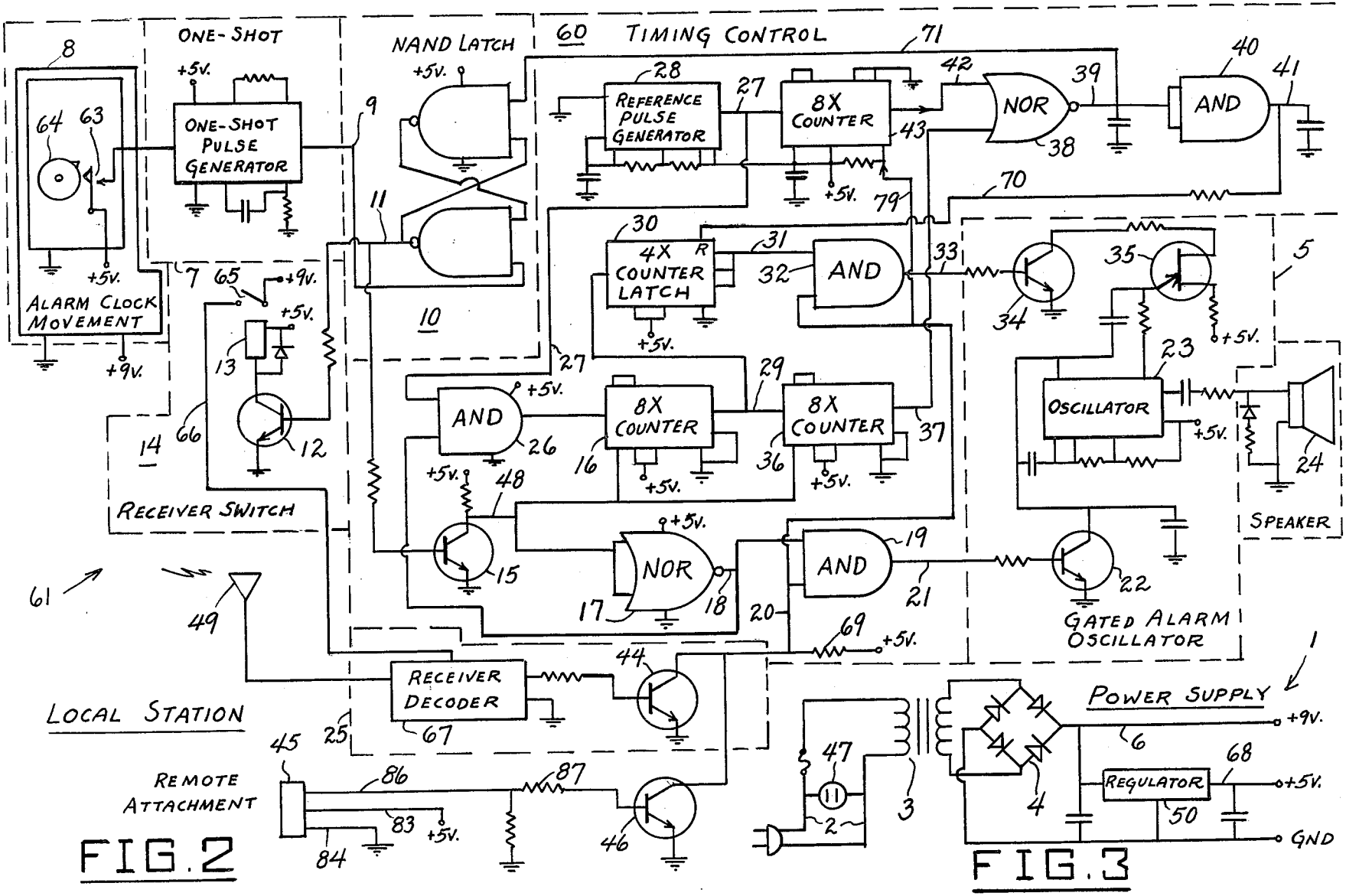
FIG. 2 is a detailed wiring diagram of the local station forming part of the clock alarm system of FIG. 1.
FIG. 3 is a wiring diagram of a power supply unit employed with the local station of FIG. 2.

Referring to FIGS. 2 and 3, the local station 61 is provided with a conventional power supply 1, energized from a convenient nearby 115 volt A.C. power source via supply wires 2,2 connected to the primary of a transformer 3 whose secondary is connected to the input terminals of a bridge rectifier 4. The output of the bridge rectifier is connected conventionally to define a +9 volt D.C. supply wire 6 leading from one output terminal of the bridge rectifier, and to provide a +5 volt D.C. supply wire 68 via a regulator 50, the remaining output terminal being grounded, as shown in FIG. 3. Instead of the power supply 1, suitable batteries may be employed to provide the required D.C. voltages.

The 9-volt output line 6 feeds the alarm clock movement 8 and the RF receiver-decoder section 25. Both the 5-volt line 68 and the 9-volt line 6 are connected to the components at the corresponding voltage points indicated in FIG. 2.

The alarm clock movement 8 is provided with a switch 63 which may be set conventionally by the user so as to close at a selected time. When switch 63 closes, for example, by the action of a cam 64 driven by the clock movement, the one-shot pulse generator circuit 7 is activated, and a pulse appears on the one-shot generator output line 9. This pulse is applied to an input terminal of NAND latch 10 and switches said latch. This generates a logic "1" signal on the NAND latch output line 11 which activates a switching transistor 12, turning on a relay 13 of the receiver switch section 14. This causes the relay contacts 65 to close, which applies +9 volts to the energizing wire 66 of the receiver-decoder 67 of the receiver-decoder section 25. The logic "1" signal on line 11 is also used to activate a transistor 15.

The output of transistor 15 is a logic "0" appearing on line 48 which enables the respective 8× counters 16 and 36. Also, the logic "0" on line 48 is applied to the input of NOR gate 17. The output of NOR gate 17 is a logic "1" signal on line 18. Line 18 is one of the input lines of AND gate 19. AND gate 19 will produce an output only when both of its input lines carry a logic "1" signal. Line 20, connected to the other input of AND gate 19 normally receives a logic "1" signal from a +5 volt terminal via a resistor 69. The logic "1" signals on lines 18 and 20 produce a logic "1" signal at the output line 21 of AND gate 19.

The logic "1" signal on line 21 enables transistor 22, which activates oscillator 23 of the alarm oscillator section 5. Oscillator 23 produces a low level alarm signal which can be heard as a continuous tone from the speaker 24.

The logic "1" signal on line 18 is applied to one input of AND gate 26, which serves as a switch for the timing pulses on line 27, derived from the output line of reference pulse generator 28. Said reference pulse generator provides an output pulse continuously every 1.25 seconds. The output pulse of AND gate 26 is fed to the input of 8× counter 16, which provides an output pulse every 10 seconds on line 29. The pulse on line 29 is fed to the input of 4× counter latch 30 which, after 40 seconds, latches and places a logic "1" signal continuously on line 31, connected to one input of an AND gate 32. The other input of AND gate 32 is fed by line 20. With a logic "1" signal on lines 31 and 20, feeding the two inputs of AND gate 32, the output of said AND gate 32 places a logic "1" signal on line 33, which is used to enable a transistor 34, which in turn activates a pulser 35, converting oscillator 23 to a pulsating generator, driving the speaker 24 so as to produce a shrill pulsating sound.

The 10-second spaced pulses on line 29 drive an 8× counter 36, placing a logic "1" output signal on line 37, 80 seconds after AND gate 26 passes its first timing pulse. The logic "1" signal on line 37 is applied to the input of NOR gate 38, causing a logic "0" signal to be placed on line 39. This feeds both inputs of an AND gate 40, thereby placing a logic "0" signal on its output line 41, which resets 4× counter latch 30 via a reset line 70. The logic "0" signal on line 39 is also used, via a reset line 71, to release the NAND latch unit 10 and to thereby reset the circuit functions to their original standby state, thus completing one maximum alarm time cycle of 80 seconds. It is noted that during the 80 seconds alarm time cycle the low level alarm sounded for the first 40 seconds and the pulsating alarm sounded for the latter 40 seconds.

Figure 4:
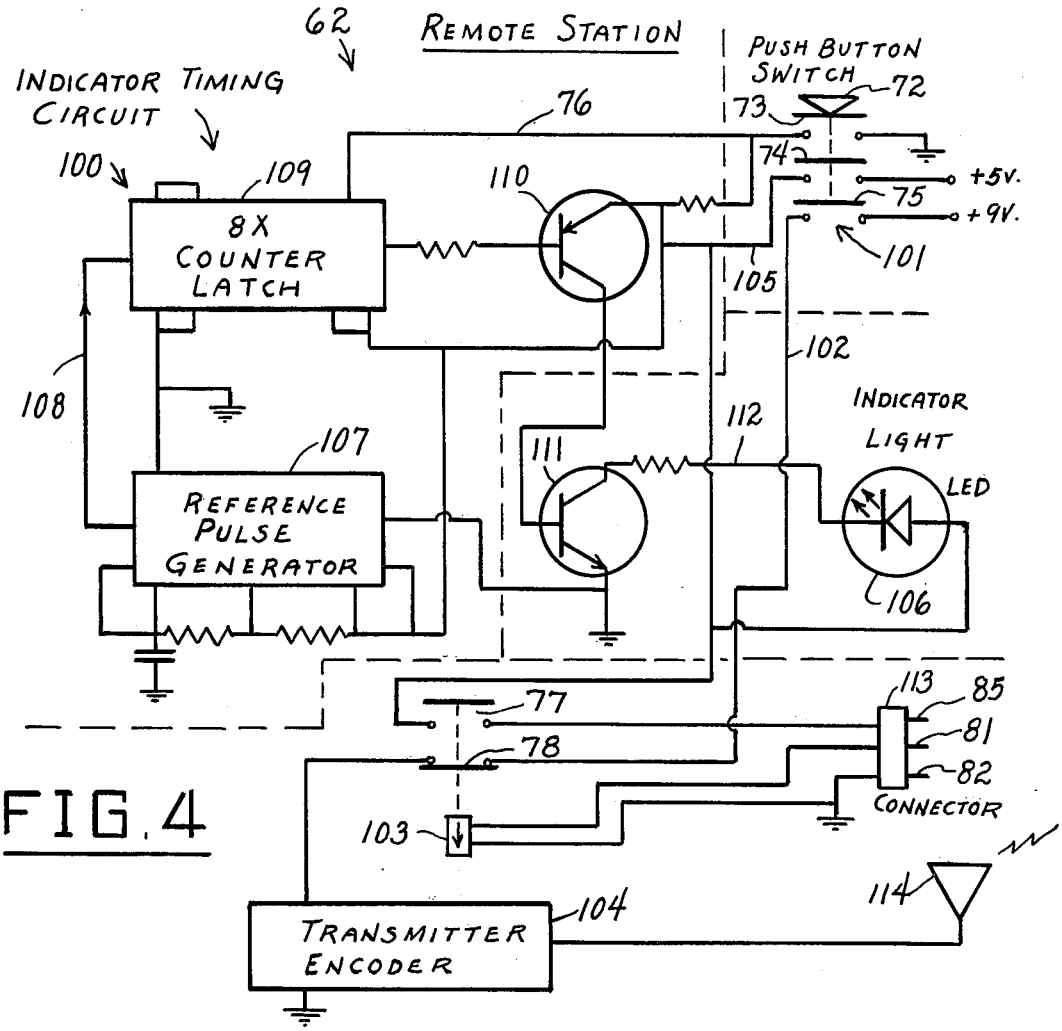
FIG. 4 is a detailed wiring diagram of the remote station which forms part of the clock alarm system of FIG. 1.
Figure 5:
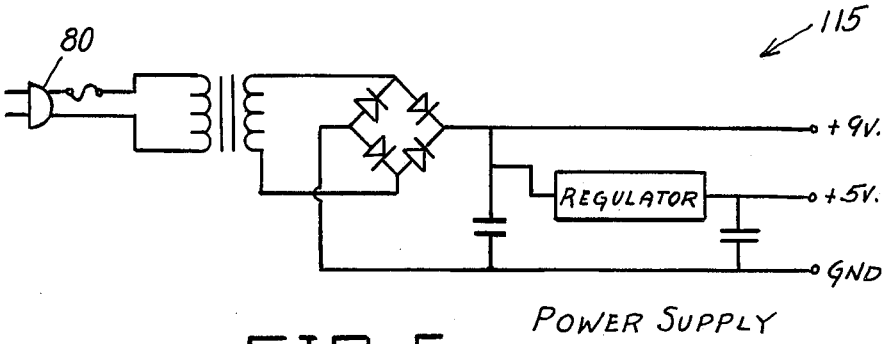
FIG. 5 is a wiring diagram of a power supply unit employed with the remote station of FIG. 4.

The audible alarm signal in operation during the 80-second alarm cycle can be interrupted and then be deactivated by depressing the push button 72 (see FIG. 4) of the remote push button switch unit 101 and keeping it depressed for 12 consecutive seconds. Referring now to FIGS. 4 and 5, the remote station 62 is energized by a power supply 115 (FIG. 5) which is substantially the same as the power supply 1, previously described.

Assuming that an alarm cycle is in progress, the push button switch 101 in the remote station 62 can be used to deactivate it. Said remote station 62 includes a reference pulse generator 107, an 8× counter latch 109, an RF transmitter-encoder 104 and an indicator lamp 106. The push button switch 101 has three poles 73, 74 and 75 and respective pairs of stationary contacts adapted to be bridged thereby when the push button 72 is depressed. When said button is depressed, pole 73 connects a line 76 to ground, pole 74 connects a line 105 to the +5 volt supply terminal, and pole 75 connects a line 102 to the +9 volt supply terminal. Wire 76 provides a required ground connection for the timer circuit. The remote station includes a normally deenergized relay 103 having normally open contacts 77 and normally closed contacts 78. The transmitter-encoder 104 is connected to line 102 via the normally closed relay contacts 78.

When push button 72 is depressed and held down, the four devices 107, 109, 104 and 106 are simultaneously activated. The +9 voltage from the power supply is applied to line 102 via pole 75 and is passed by the closed contacts 78 to relay 103 to activate the RF transmitter-encoder 104. The +5 voltage from the power supply is applied to line 105 via switch pole 74. The 8× counter latch 109 and the reference pulse generator 107 are activated from line 105. The activation of counter latch 109 turns on a transistor 110, which in turn renders a switch transistor 111 conducting. Indicator lamp 106 is activated from line 105 via switching transistor 111, which provides the ground return for the lamp circuit.

The RF transmitter-encoder 104 transmits a coded signal between its antenna 114 and the antenna 49 of the RF receiver-decoder 67 located in the clock component of the system. The signal received by the antenna 49 (FIG. 2) is decoded by the RF receiver-decoder 67. The output of the RF receiver-decoder 67 switches the transistor 44 output to a logic "0" signal on line 20. The logic "0" signal on line 20 turns off AND gates 19 and 32, disabling transistors 22 and 34. This results in an interruption of the operation of oscillator 23, silencing the speaker 24. Also, the logic "0" signal on line 20 enables 8× counter 43 via line 79, causing 8× counter 43 to be driven by the pulses from reference pulse generator 28. The 8× counter 43 develops a logic "1" output signal 10 seconds after it is enabled. The output of 8× counter 43 on line 42 is fed to an input of NOR gate 38. Following this, via lines 70 and 71 the same action described above takes place to accomplish the resetting of the 4× counter latch 30 and the NAND latch 10, thus terminating the alarm cycle.

The circuitry at the remote station, other than the transmitter-encoder 104, is provided only for the purpose of indicating when the switch push button 72 has been held in a depressed state long enough for the alarm cycle to have been deactivated. The clock's audible alarm cannot provide the indication, since it is interrupted during the time interval that the remote push button 72 is in a depressed state. After the push button is depressed, reference pulse generator 107 develops an output pulse every 1.5 seconds. The output pulses are fed on line 108 to the input of the 8× counter latch 109. After a duration of 12 seconds, the 8× counter latch 109 latches up, applying a signal to transistor 110 which deactivates switching transistor 111. With switching transistor 111 deactivated, no current is permitted to flow in the indicator light line 112. Consequently, the indicator light 106 is disabled in 12 seconds.

Although only 10 seconds is required to deactivate the alarm cycle circuitry in the local (clock) station 61 (FIG. 2), a 12-second time interval is used by the circuitry in the remote control station 62 to compensate for any circuit delay time and transmission tolerance.

If the switch push button 72 is released short of a 12-second time period, the 8× counter latch 109 resets, and all other devices in the remote control station 62 return to the standby condition. The push button 72 must again be held in a depressed condition to start another 12-second time period. (Premature release of button 72 deenergizes transmitter-encoder 104, terminating the RF signal to receiver-decoder 67 and causing the output of transistor 44 to change to a logic "1" signal on line 20. The logic "1" signal on line 20 again enables AND gates 19 and 32, enabling transistors 22 and 34 to restore operation of oscillator 23 and enabling a normal alarm cycle).

The system may be employed in a manner providing direct transmission of a deactivation signal to the alarm circuitry, if so desired. Thus, for example, the remote equipment of station 62 can be plugged directly into the clock station 61 whenever remote operation is not required. This is accomplished by providing respective mating connectors 113 and 45 for the remote station component 62 and the local station component 61, for example, a 3-prong male connector 113 for station 62 and a mating 3-hole female connector for station 61. Also, a convenience A.C. receptacle 47 is provided, connected across the main supply wires 2, 2 for the local station power supply 1, adapted to receive the A.C. power connection plug 80 of the power supply 115 associated with station 62.

As shown in FIG. 4, the winding of relay 103 is connected to the prongs 81 and 82 of male plug 113. These prongs are adapted to connect with the 5-volt supply wires 83, 84 of female socket 45, thereby to energize relay 103 when male connector 113 is plugged into female connector 45. This opens contacts 78 and disables the transmitter-encoder 104. The remaining prong 85 of male connector 113 connects with a wire 86 leading from the remaining female receptacle of connector 45 via a resistor 87 to the base of a transistor switch 46 forming part of the local station circuitry. When relay contacts 77 are closed, the depression of push button 72 places +5 volts on line 105 via pole 74, and this voltage is transmitted via prong 85 and wire 86 to the base of switch transistor 46. The output of transistor 46 places a logic "0" signal on the input line 20 of AND gates 19 and 32, achieving the same deactivation function of the alarm cycle circuitry as occurs when the RF transmitter-encoder 104 is employed in the above-described remote control mode of operation.

Another possible direct transmission mode according to the present invention between a clock station 61 and a remote control station 62 is a direct wire connection between transmitter-encoder 104 and receiver-decoder 67, using a coaxial cable connected to provide direct coupling instead of employing transmitting and receiving antennae.

In the various above-described forms of the present invention, the circuitry of the system is quiescent until the alarm time set in the alarm clock movement arrives and causes the electric alarm switch 63 to be activated. Consequently, the circuitry of the invention is only active during the process of one alarm cycle, which may operate, for example, for a maximum duration of 80 seconds.

Although the specific embodiments of the invention described above employ control of the alarm by radio transmission from a remote station or by direct electrical connections, other known methods and means for transmitting control signals from a remote station to a local station may be employed within the spirit of the present invention, such as (a) as by sonic signals which are emitted by the remote station component, transmitted through the air, and detected by microphone means at the clock component, (b) by electrical impulses which are generated by the remote station component and channeled through the electrical wiring system of the building structure via the electrical wall outlets into which both components are plugged, or (c) by optical light wave frequencies which are channeled through fiber optic cables from the remote component to the clock component. Another possible modification is the replacement of the remote station by a key switch which employs a key which must be inserted into the clock component and turned in order to deactivate the alarm. This key could be situated in an area outside of the sleeping area such as would require the user to get out of bed and travel to and from the key's location in order to deactivate the alarm. Still another possible modification would be to replace the remote station with a Touch Tone switch system, wherein in order to deactivate the alarm cycle the user must activate a group of push buttons in a specific sequence, similar to dialing a number in a Touch Tone telephone system.

Also contemplated within the spirit of the present invention is the employment of a battery back-up system which would ensure the continued energization of the clock alarm cycle even if the operator, in an effort to avoid getting out of bed, removes the power supply plug of the system from its wall socket. Such a battery substitution system would also serve to ensure operation of the clock alarm system in the event of a power failure produced by any other cause.

While certain specific embodiments of improved alarm clock systems have been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiments.

What is claimed is:

1. An alarm clock system comprising a clock movement including alarm starting means for producing an electrical alarm signal, means to generate an audible alarm responsive to said electrical alarm signal, manually operated deactivation switch means, circuit means to deactivate said audible alarm immediately upon manual operation of said deactivation switch means, and completely responsive to continuous manual operation of said deactivation switch means for a predetermined extended period of time, a visual indicator adjacent said deactivation switch means, means to energize said visual indicator when said deactivation switch means becomes manually operated, and means to deenergize said visual indicator responsive to the continuous manual operation of said deactivation switch means for said predetermined extended period of time.

2. The alarm clock system of claim 1, and wherein said audible alarm generating means includes means to generate a continuous audible alarm tone for a first predetermined period of time and means to generate a second different alarm sound for a second period of time following said first period.

3. The alarm clock system of claim 2, and wherein said second alarm sound comprises relatively shrill pulsations.

4. The alarm clock system of claim 1, and wherein said deactivation switch means is located at a remote location relative to said clock movement, whereby the user must travel to said remote location in order to manually operate said deactivation switch means.

5. The alarm clock system of claim 1, and wherein said alarm clock system includes a radio link between said deactivation switch means and said audible alarm-generating means.

6. The alarm clock system of claim 1, and wherein said deactivation switch means is provided with a radio frequency deactivation signal transmitter, and wherein said audible alarm generating means is provided with a radio receiver in coupling relation with said transmitter, and means to deactivate said audible alarm generating means responsive to a deactivation radio signal from said transmitter which is received by said radio receiver.

7. The alarm clock system of claim 1, and wherein said deactivation switch means comprises a manual switch and a radio frequency transmitter controlled by said manual switch and energized responsive to the manual operation of said switch, and wherein said alarm deactivation means includes a radio receiver in coupling relation with said transmitter, and means to initially turn off the audible alarm when the radio receiver detects a radio signal from said transmitter, and means to turn off the audible alarm completely when the radio signal has been sustained continuously for said predetermined extended period of time.

8. The alarm clock system of claim 1, and means to cause resumption of the audible alarm if the deactivation switch means is released prior to the expiration of said predetermined extended period of time.

9. The alarm clock system of claim 1, and wherein said audible alarm-generating means comprises NAND latch means, means to set said NAND latch means responsive to said electrical alarm signal, a sound reproducer, alarm oscillator means drivingly connected to said sound reproducer, timed energizing means operatively connected to said oscillator means, and means to activate said timed energizing means responsive to the setting of said NAND latch means.

10. The alarm clock system of claim 1, and wherein said audible alarm-generating means comprises NAND latch means, means to set said NAND latch means responsive to said electrical alarm signal, a sound reproducer, alarm oscillator means drivingly connected to said sound reproducer, energizing means operatively connected to said oscillator means, timing control means connected to said energizing means and defining a maximum audible alarm period, and means to activate said energizing means and timing control means responsive to the setting of said NAND latch means.

11. The alarm clock system of claim 10, and means to reset said NAND latch means at the end of said maximum audible alarm time period.

12. The alarm clock system of claim 10, and wherein said circuit means to immediately deactivate said audible alarm comprises means to disable said oscillator means responsive to manual operation of said deactivation switch means, and wherein said means to deactivate the audible alarm completely comprises means to reset said NAND latch means responsive to the continuous manual operation of said deactivation switch means for said predetermined extended period of time.

13. An alarm clock system comprising a clock movement including alarm starting means for producing an electrical alarm signal, means to generate an audible alarm responsive to said electrical alarm signal, manually operated deactivation switch means, circuit means to deactivate said audible alarm immediately upon manual operation of said deactivation switch means, and completely responsive to continuous manual operation of said deactivation switch means for a predetermined extended period of time, wherein said alarm clock system includes a radio link between said deactivation switch means and said audible alarm-generating means, and wherein said radio link is normally disabled, and means to enable said radio link responsive to said electrical alarm signal.

14. The alarm clock system of claim 13, and indicating means to show the expiration of said predetermined extended period of time.

15. An alarm clock system comprising a clock movement including alarm starting means for producing an electrical alarm signal, means to generate an audible alarm responsive to said electrical alarm signal, manually operated deactivation switch means, circuit means to deactivate said audible alarm immediately upon manual operation of said deactivation switch means, and completely responsive to continuous manual operation of said deactivation switch means for a predetermined extended period of time, and wherein said deactivation switch means includes a push button switch, an indicator lamp, means to energize said lamp when said push button switch becomes manually operated, and means to deenergize said lamp after the push button switch has been manually held operated for said predetermined extended period of time.

16. An alarm clock system comprising a clock movement including alarm starting means for producing an electrical alarm signal, means to generate an audible alarm responsive to said electrical alarm signal, manually operated deactivation switch means, circuit means to deactivate said audible alarm immediately upon manual operation of said deactivation switch means, and completely responsive to continuous manual operation of said deactivation switch means for a predetermined extended period of time, wherein said deactivation switch means comprises a manual switch and a radio frequency transmitter controlled by said manual switch and energized responsive to the manual operation of said switch, wherein said alarm deactivation means includes a radio receiver in coupling relation with said transmitter, means to initially turn off the audible alarm when the radio receiver detects a radio signal from said transmitter, and means to turn off the audible alarm completely when the radio signal has been sustained continuously for said predetermined extended period of time, and wherein said manual switch and transmitter are normally located at a remote location relative to said clock movement, means to at times directly connect said manual switch to said alarm-deactivating circuit means, and means to disable said transmitter when said manual switch is thus directly connected to said alarm-deactivating circuit means.

17. An alarm clock system comprising a clock movement including alarm starting means for producing an electrical alarm signal, means to generate an audible alarm responsive to said electrical alarm signal, manually operated deactivation switch means, circuit means to deactivate said audible alarm immediately upon manual operation of said deactivation switch means, and completely responsive to continuous manual operation of said deactivation switch means for a predetermined extended period of time, wherein said deactivation switch means comprises a manual switch and a radio frequency transmitter controlled by said manual switch and energized responsive to the manual operation of said switch, wherein said alarm deactivation means includes a radio receiver in coupling relation with said transmitter, means to initially turn off the audible alarm when the radio receiver detects a radio signal from said transmitter, and means to turn off the audible alarm completely when the radio signal has been sustained for said predetermined extended period of time, and indicating means to show the expiration of said predetermined extended period of time, and wherein said indicating means comprises a lamp, means to energize said lamp responsive to manual operation of said switch, and means to deenergize said lamp at the expiration of said predetermined extended period of time.

18. The alarm clock system of claim 17, and wherein said means to deenergize said lamp comprises electronic time counter means, and electronic switch means in circuit with said lamp and controlled by said time counter means.

19. An alarm clock system comprising a clock movement including alarm starting means for producing an electrical alarm signal, means to generate an audible alarm responsive to said electrical alarm signal, manually operated deactivation switch means, and circuit means to deactivate said audible alarm immediately upon manual operation of said deactivation switch means, and completely responsive to continuous manual operation of said deactivation switch means for a predetermined extended period of time, and wherein said deactivation switch means includes a push button switch, an indicator lamp, means to energize said lamp when said push button switch becomes manually operated and includes electronic switch means in circuit with said lamp, means to render said electronic switch means conducting responsive to manual actuation of said push button switch, and timer means to open said electronic switch means after said predetermined extended period of time, whereby to deenergize said indicator lamp.

20. An alarm clock system comprising a clock movement including alarm starting means for producing an electrical alarm signal, means to generate an audible alarm responsive to said electrical alarm signal, manually operated deactivation switch means, circuit means to deactivate said audible alarm immediately upon manual operation of said deactivation switch means, and completely responsive to continuous manual operation of said deactivation switch means for a predetermined extended period of time, electrical indicator means, means to energize said electrical indicator means when said deactivation switch means becomes manually operated, and means to deenergize said electrical indicator means responsive to the continuous manual operation of said deactivation switch means for said predetermined extended period of time.

* * * * *